US005368657A

United States Patent [19]

Anderson et al.

[11] Patent Number: 5,368,657

[45] Date of Patent: Nov. 29, 1994

[54] GAS ATOMIZATION SYNTHESIS OF REFRACTORY OR INTERMETALLIC COMPOUNDS AND SUPERSATURATED SOLID SOLUTIONS

[75] Inventors: Iver E. Anderson; Barbara K. Lograsso; Timothy W. Ellis, all of Ames, Iowa

[73] Assignee: Iowa State University Research Foundation, Inc., Ames, Iowa

[21] Appl. No.: 48,138

[22] Filed: Apr. 13, 1993

[51] Int. Cl.[5] ..... B22F 9/00; B22D 23/00

[52] U.S. Cl. ..... 148/400; 75/338; 148/316

[58] Field of Search ..... 148/316, 400; 75/338

[56] References Cited

U.S. PATENT DOCUMENTS

| | | | |
|---|---|---|---|
| 3,904,448 | 9/1975 | Takahashi et al. | 148/105 |
| 4,336,242 | 6/1982 | Schmidberger et al. | 423/594 |
| 4,402,770 | 9/1983 | Koon | 420/435 |
| 4,533,408 | 8/1985 | Koon | 148/103 |
| 4,585,473 | 4/1986 | Narasimhan et al. | 148/101 |
| 4,597,938 | 7/1986 | Matsuura et al. | 148/105 |
| 4,619,845 | 10/1986 | Ayers et al. | 427/422 |
| 4,758,405 | 7/1988 | Couper | 75/338 |
| 4,801,340 | 1/1989 | Inoue et al. | 148/103 |
| 4,802,931 | 2/1989 | Croat | 148/302 |
| 4,867,809 | 9/1989 | Haverstick | 148/101 |
| 4,919,854 | 4/1990 | Walz | 75/338 |
| 4,999,052 | 3/1991 | Wilson | 75/338 |
| 5,024,695 | 6/1991 | Ashdown et al. | 75/338 |
| 5,073,409 | 12/1991 | Anderson et al. | 427/426 |
| 5,090,997 | 2/1992 | Birkenstock et al. | 75/338 |
| 5,114,470 | 5/1992 | Biancaniello et al. | 75/338 |
| 5,125,574 | 6/1992 | Anderson et al. | 239/8 |
| 5,190,701 | 3/1993 | Larsson | 75/338 |
| 5,196,049 | 3/1993 | Combs et al. | 75/338 |

FOREIGN PATENT DOCUMENTS

| | | |
|---|---|---|
| 63-100108 | 5/1988 | Japan . |
| 63-109101 | 6/1988 | Japan . |

*Primary Examiner*—Uprendra Roy
*Attorney, Agent, or Firm*—Flynn, Thiel, Boutell & Tanis

[57] ABSTRACT

A metallic melt is atomized using a high pressure atomizing gas wherein the temperature of the melt and the composition of the atomizing gas are selected such that the gas and melt react in the atomization spray zone to form a refractory or intermetallic compound in the as-atomized powder particles.

A metallic melt is also atomized using a high pressure atomizing gas mixture gas wherein the temperature of the melt and the ratio of a reactive gas to a carrier gas are selected to form powder particles comprising a supersaturated solid solution of the atomic species of the reactive gas in the particles. The powder particles are then heat treated to precipitate dispersoids in-situ therein to form a dispersion strengthened material.

18 Claims, 6 Drawing Sheets

GAS ATOMIZATION SYNTHESIS OF REFRACTORY OR INTERMETALLIC COMPOUNDS AND SUPERSATURATED SOLID SOLUTIONS

CONTRACTUAL ORIGIN OF THE INVENTION

The United States Government has rights in this invention pursuant to Contract No. W-7405-ENG-82 between the U.S. Department of Energy and Iowa State University.

FIELD OF THE INVENTION

The present invention relates to a method of making atomized powder particles having refractory or intermetallic compounds formed therein by gas reaction synthesis between a melt as one component and a reactive atomizing gas as another component in an atomization spray zone. The present invention also relates to a method of making atomized powder particles having a supersaturated solid solution of a dispersoid-forming species therein and to treating the powder particles to form an in-situ dispersion strengthened material. The present invention also involves powder products produced by these methods.

BACKGROUND OF THE INVENTION

Interest has been shown recently in the use of intermetallic compounds (such as aluminides, silicides, germanides, etc.) and refractory compounds (such as nitrides, borides etc.) for engineering use. Many of these compounds exhibit exceptionally high melting points, chemical inertness, and enhanced strength at elevated temperatures. These compounds represent new opportunities for technological materials advancement important to energy production and conservation, high speed aircraft, military systems, and chemical process industries.

However, methods of production and fabrication of these compounds have proven to be difficult. For example, the formation of many of these compounds is extremely exothermic, making containment during synthesis a considerable problem. Additionally, many of these compounds exhibit high melting points together with high reactivity in the liquid state, complicating conventional crucible melting practice that otherwise might be used in their manufacture. Furthermore, the low ductility exhibited by such compounds as fabricated by conventional casting techniques makes subsequent deformation processing virtually impossible. Although some of these compounds have been formed by the use of powder metallurgy techniques, the production of suitable powder material has proven time consuming, expensive, and hindered by crucible contamination and/or contamination from grinding operations. Plasma arc production has been used for the production of some of these compounds, but requires a high capital investment which adds to the cost of these materials.

There is a need for a method of producing these compounds in a manner that circumvents the aforementioned raw material production and component fabrication problems heretofore associated with these compounds.

Interest has also been shown for some time in dispersion strengthened metallic materials wherein the material typically comprises a metal or alloy (hereafter referred to as metallic) matrix having dispersoids distributed uniformly throughout for strength enhancing purposes. Such dispersion strengthened materials have been made by internal oxidation of the matrix to produce, for example, a metal matrix having a dispersion of fine oxide particles therein. Another method for the production of dispersion strengthened material has involved mechanical compaction of a mixture of the metallic powder and the dispersoid powders. Attempts have also been made to cast a metallic melt containing the dispersoids therein in a mold to form such materials.

Another method of making dispersion strengthened materials is the so-called "mechanical alloying" process of International Nickel Corporation wherein a blended mixture of matrix powder and dispersoid powder is mechanically attrited for long times to reduce the particle sizes and to force an intimate bonding of the two phases to form "composite" particulate. Still another method involves mixing powdered components followed by pressing and sintering.

There is a need for a method for making dispersion strengthened materials from a precursor material that can be readily treated to form the desired dispersoids in-situ in the metallic matrix.

The so-called XD process developed by Martin Marietta Corporation represents one attempt to provide such a method. The XD process forms second phase dispersoids (e.g. titanium diboride, titanium carbide, etc.) in-situ in a metallic matrix (e.g. aluminum matrix) as described, for example, in U.S. Pat. Nos. 4,710,348, 4,772,452, 4,751,048, 4,836,982, 4,915,905, and 4,915,908.

Gas atomization is a commonly used technique for economically making fine metallic powder by melting the metallic material and then impinging a gas stream on the melt to atomize it into fine molten droplets that are solidified to form the powder. One particular gas atomization process is described in the Ayers and Anderson U.S. Pat. Nos. 4,619,845 wherein a molten stream is atomized by a supersonic carrier gas to yield fine metallic powder (e.g., powder sizes of 10 microns or less). Anderson U.S. Pat. No. 5,073,409 and 5,125,574 describe high pressure gas atomization of a melt in a manner to form a thin protective refractory nitride surface layer or film on the atomized powder particles. The '409 patent uses an atomizing gas, such as nitrogen, that selectively reacts with an alloy constituent to form the protective surface layer. The '574 patent uses an inert atomizing gas and a reactive gas contacted with the atomized droplets at a selected location downstream of the atomizing nozzle to form the protective layer. Various prior art techniques for forming protective layers on atomized powder by reacting a gaseous species with the melt, or a component of the melt, are discussed in these patents.

It is an object of the present invention to provide a method of making atomized powder particles having a refractory or intermetallic compound formed therein by gas atomizing a metallic melt under melt temperature and atomizing gas reactivity conditions effective to form the desired compound throughout the atomized particles.

It is another object of the invention to provide a method of making atomized powder particles having a supersaturated solid solution of a dispersoid-forming species present therein by gas atomizing a metallic melt under melt temperature and atomizing gas reactivity conditions effective to achieve superequilibrium concentrations of the species in the atomized particles.

It is still another object of the present invention to provide a method of making a dispersion strengthened material wherein metallic powder particles supersaturated with a dispersoid-forming species by reactive gas atomization are heat treated to react the species with the host metallic material to form fine dispersoids in-situ in the metallic powder.

SUMMARY OF THE INVENTION

One aspect of the present invention involves a method of making particulates having a supersaturation of a dispersoid-forming specie dissolved in solid solution in the particulates to a depth below an outer surface of the particulates, preferably inwardly through the particles to a depth of at least about 0.1 micron, even more preferably substantially throughout the particle lateral dimension (e.g. particle diameter). The method comprises the steps of forming a superheated melt comprising a metallic (i.e. metal or alloy) material and atomizing the melt with an atomizing gas mixture comprising a carrier gas and a second reactive gas so as to form atomized particulates. The temperature of the melt and the ratio of the carrier gas to the second gas (e.g. volume ratio) are selected effective to provide a superequilibrium concentration of the atomic specie of the second gas in solid solution in the particulates as a dispersoid-forming specie. Preferably, the carrier gas is present as a majority (vol. %) of the atomizing gas or while the second gas is present as a minority (vol %) of the atomizing gas. The atomizing gas preferably comprises an inert gas (e.g. Ar) and a reactive gas that will react, when dissolved in supersaturated solid solution in the metallic particle matrix material, to form dispersoids therein.

Still another aspect of the present invention involves a method of dispersion strengthening a metallic material wherein a superheated melt comprising the metallic material is formed and atomized with an atomizing gas to produce atomized particulates. The atomizing gas comprises a carrier gas and a dispersoid-forming gas that is reactive when dissolved in solid solution in the metallic material to form dispersoids therein. The temperature of the melt and the ratio of the carrier gas to the reactive gas are selected effective to provide a superequilibrium concentration of the atomic specie of the dispersoid-forming gas in solid solution in at least a surface region of the particulates.

The particulates can be heated to a temperature to react the atomic specie of the reactive gas with the metallic material to form dispersoids therein. Alternately, the atomized particulates having a super-equilibrium concentration of the dispersoid-forming specie are formed into an article, and the article then is heated to a temperature to react the dissolved specie with the metallic material to form dispersoids in the article.

Another aspect of the present invention involves a method of making particulates comprising a refractory or intermetallic compound having a first metallic component and a second non-metallic or metallic component. The method comprises forming a superheated melt under an inert gas atmosphere comprising the first metallic component of the compound, and atomizing the melt with an atomizing gas comprising a reactive material that is reactive with the melt to provide the second non-metallic or metallic component of the compound. The temperature of the melt and reactivity of the reactive material are selected effective to form the refractory or intermetallic compound in-situ in the atomized particles in the atomization spray zone. The refractory or intermetallic compound is formed to a depth below the outer surface of the particulates, preferably inwardly through the particles to a depth of at least about 0.1 micron, preferably substantially through the particle lateral dimension (e.g. particle diameter).

The chemical reaction between the melt and the reactive material in the atomization spray zone is thermodynamically driven by the heat of the reaction and the superheat of the melt. The atomized particles rapidly solidify to produce atomized powder particles comprising the refractory or intermetallic compound therein.

In one embodiment of the invention, the atomizing gas comprises nitrogen, borane, or an organo-metallic reactive material so as to form atomized powder particles comprising a nitride, boride, or intermetallic compound, respectively.

Melt atomization in combination with synthesis of the refractory or intermetallic compound in the atomization spray zone avoids the difficulties heretofore encountered in conventional solidification processing of refractory or intermetallic compounds resulting from their high melting points and extreme chemical reactivity.

Gas atomized powder particles in accordance with a still further aspect of the present invention comprise a metallic matrix material and a superequilibrium concentration of a dispersoid-forming specie dissolved in solid solution in the particles to a depth from a particle outer surface of at least about 0.1 micron, preferably substantially through the particulate diameter. The dispersoid-forming specie is reactive with the metallic matrix material to form dispersoids therein upon heating.

Gas atomized powder particles in accordance with a still another aspect of the present invention comprise a refractory or intermetallic compound formed in-situ therein during atomization.

The aforementioned objects and advantages of the present invention will become more readily apparent from the following detailed description taken in conjunction with the drawings.

DESCRIPTION OF THE DRAWINGS

In FIG. 2A, the elements Al, C, N and O were measured. In FIG. 2B, the results for N and O from FIG. 2A are highlighted.

DETAILED DESCRIPTION OF THE INVENTION

Figure 1:
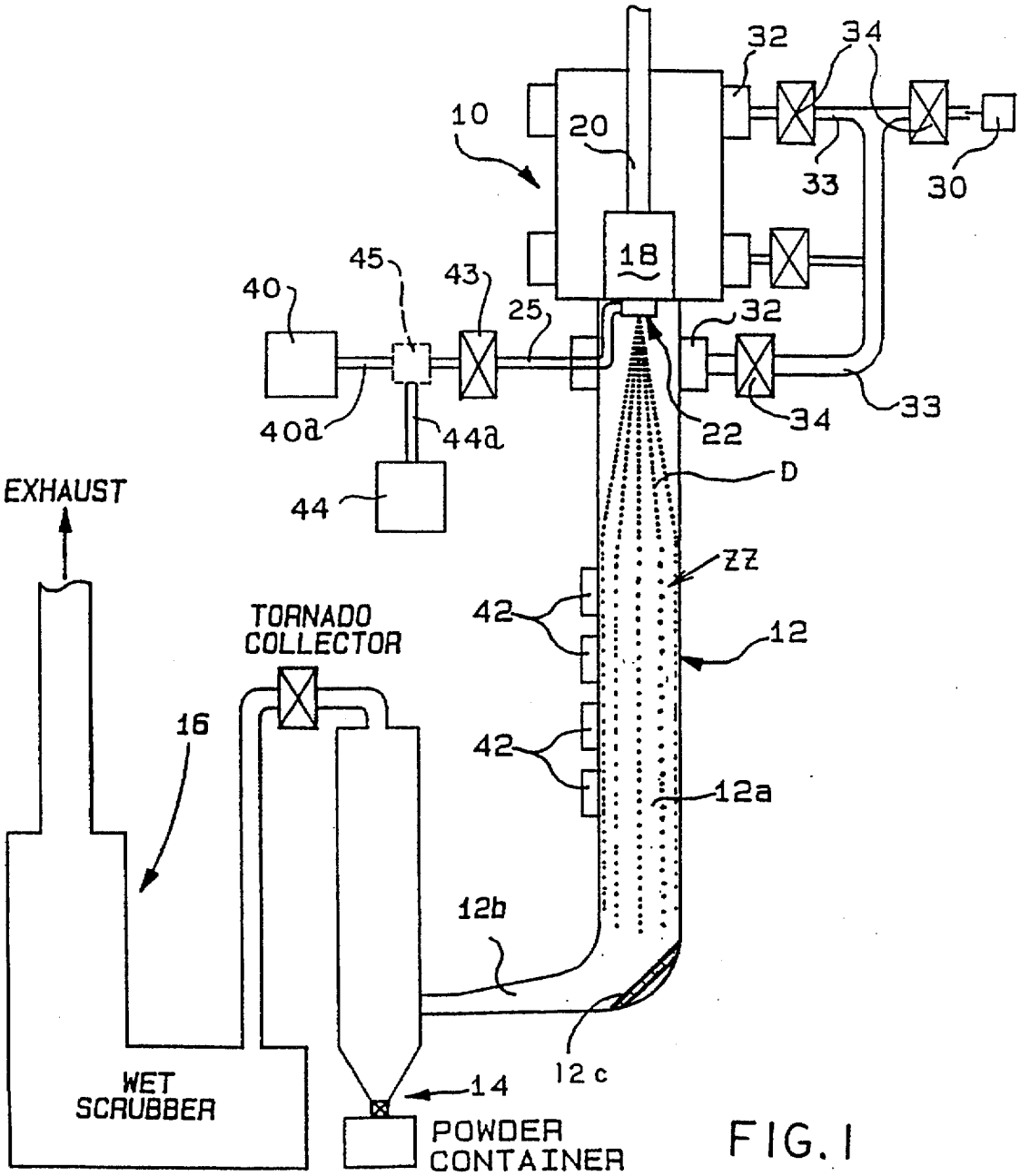
FIG. 1 is a schematic view of atomization apparatus for practicing one embodiment of the invention.

Referring to FIG. 1, a gas atomization apparatus is shown for practicing one embodiment of the present invention. The apparatus includes a melting chamber 10, a drop tube 12 beneath the melting chamber, a powder collection chamber 14 and an exhaust cleaning system 16. The melting chamber 10 includes an induction melting furnace 18 and a vertically movable stopper rod 20 for controlling flow of melt from the furnace 18 to a melt atomizing nozzle 22 disposed between the furnace and the drop tube. The atomizing nozzle 22 preferably is of the supersonic gas type described in the Anderson U.S. Pat. No. 5,125,574, the teachings of which are incorporated herein by reference with respect to nozzle construction. The atomizing nozzle 22 is supplied with an atomizing gas in a manner to be described through a conduit 25 and an open/close valve 43. As shown in FIG. 1, the atomizing nozzle 22 atomizes melt in the form of a spray of generally spherical, molten droplets D into the drop tube 12. An atomization spray zone ZZ is thus formed in the drop tube 12 beneath or downstream of the nozzle 22 in the drop tube 12 to the elbow **12*d* leading to lateral section 12*b***.

Both the melting chamber 10 and the drop tube 12 are connected to an evacuation device (e.g., vacuum pump) 30 via suitable ports 32 and conduits 33. Prior to melting and atomization of the melt, the melting chamber 10 and the drop tube 12 are evacuated to a level of about $30\times10^{-3}$ torr to substantially remove ambient air. Then, the evacuation system is isolated from the chamber 10 and the drop tube 12 via the valves 34 shown and the chamber 10 and drop tube 12 are positively pressurized by an inert gas (e.g., argon to about 1.1 atmosphere) to prevent entry of ambient air thereafter.

The drop tube 12 includes a vertical drop tube section **12*a* and a lateral section 12*b* that communicates with the powder collection chamber 14. The drop tube vertical section 12*a* has a generally circular cross-section having a diameter in the range of 1 to 3 feet, a diameter of 1 foot being used in the Examples set forth below. A disposable thin sheet metal (e.g. type 304 stainless steel or Ta metal) splash member 12*c* is fastened by bolts (not shown) at the elbow or junction 12*d* of the drop tube vertical section 12*a* and lateral section 12*b***.

The length of the vertical drop tube section **12*a*** is typically about 9 to about 16 feet, a preferred length of 9 feet being used in the Examples set forth below, although other lengths can be used in practicing the invention.

Powder collection is accomplished by separation of the powder particles/gas exhaust stream in the tornado centrifugal dust separator/collection chamber 14 by retention of separated powder particles in the valved powder-receiving container, FIG. 1.

A plurality of temperature sensing means 42 (shown schematically), such as radiometers or laser doppler velocimetry devices, may be spaced axially apart along the length of the vertical drop section **12*a*** to measure the temperature or velocity, respectively, of the atomized droplets D as they fall through the drop tube and cool in temperature.

One embodiment of the present invention involves forming powder particles that comprise a metallic matrix (i.e. metal or alloy matrix) and a superequilibrium concentration of an atomic specie of a gas dissolved in solid solution in the powder particles to a substantial depth below the outer surface of the particles. In particular, a superheated melt comprising the metallic matrix material is formed in a crucible (not shown) preferably under an inert gas atmosphere in the melting furnace 18 and atomized using atomizing nozzle 22 to produce atomized powder particulates. The atomizing gas supplied to the nozzle 22 comprises a mixture including a carrier gas and a second reactive gas or liquid that is reactive when dissolved as an atomic specie in solid solution in the metallic matrix material to form dispersoids in-situ therein.

The carrier gas and second gas are supplied either from a premixed high pressure gas mixture cylinder or from conventional sources, such as high pressure cylinders or pressurized bottles 40 and 44, respectively, and mixed in the common conduit 25 that is communicated to the atomizing nozzle 22. The carrier gas typically comprises an inert gas, such as preferably ultra high purity argon, although the invention is not limited to use of inert gas as a carrier gas. If a liquid reactive material is used, it can be supplied from a pressurized cylinder and mixed with the carrier gas in a carburetor-like chamber 45 (shown schematically in FIG. 1) located at the junction of the individual supply conduits **40*a*, 44*a***.

The second, reactive gas is selected to introduce a desired reactive (dispersoid-forming) atomic specie in solid solution in the powder matrix material. For example, the second, reactive gas can comprise ultra high purity nitrogen when it is desired to form powder particles having atomic nitrogen dissolved in solid solution therein for purposes of forming nitride dispersoids in-situ therein by a subsequent heat treatment. The second, reactive gas can comprise ultra high purity borane when it is desired to form powder particles having atomic boron dissolved in solid solution therein for purposes of forming boride dispersoids in-situ therein by a subsequent heat treatment. Reactive liquids for use with the carrier gas include, but are not limited to, $NH_3$ or metal carbonyl. Other appropriate carrier gas/reactive gas mixtures can used as the atomizing gas to make powder particles having atomic oxygen, carbon, silicon, germanium, etc., dissolved in solid solution therein to form oxide, carbide, silicide, germanides, etc. dispersoids in-situ therein by subsequent heat treatment.

This embodiment of the invention involves the discovery that a surprisingly high superequilibrium concentration of an atomic specie of the second, reactive gas or liquid can be dissolved in solid solution in the atomized powder particles by proper selection of the temperature of the melt and the ratio of the carrier gas to the second, reactive gas or liquid. In particular, a surprisingly high concentration of dissolved atomic specie of the second, reactive gas in the atomized powder particles beyond the predicted equilibrium concentration can be achieved by atomization of the melt (1) at a melt superheat temperature that is not high enough to cause vaporization of the atomized droplets in the spray zone ZZ and yet is high enough to promote high fluidity and atomic mobility within the liquid atomized droplets and (2) at a ratio of carrier gas-to-second gas that is high enough (low enough partial pressure of the second gas) to substantially prevent reaction of the second gas with the atomized melt in the atomization spray zone ZZ in a manner to form compound(s) therewith and that is low enough (high enough partial pressure of the second gas) to achieve substantial dissolution of the atomic specie of the second gas in at least the surface region of the atomized melt particles in the atomization spray zone ZZ. Preferably, the carrier gas is present as a majority (vol. %) of the atomizing gas or while the second gas is present as a minority (vol. %) of the atomizing gas.

The cooling rate of the melt droplets in the atomization spray zone ZZ is sufficiently rapid to trap or quench the dissolved atomic specie of the second, reactive gas in solid solution to at least a substantial depth below the outer surface of the atomized particles (e.g. a region at least about 0.1 micron in depth from the outer particle surface) as they rapidly solidify in the atomization spray zone ZZ. The particles solidify wholly (i.e. through the entire cross-section) in the atomization spray zone ZZ to provide a generally spherical particle shape and trap the dissolved specie in the matrix.

Figure 2A:
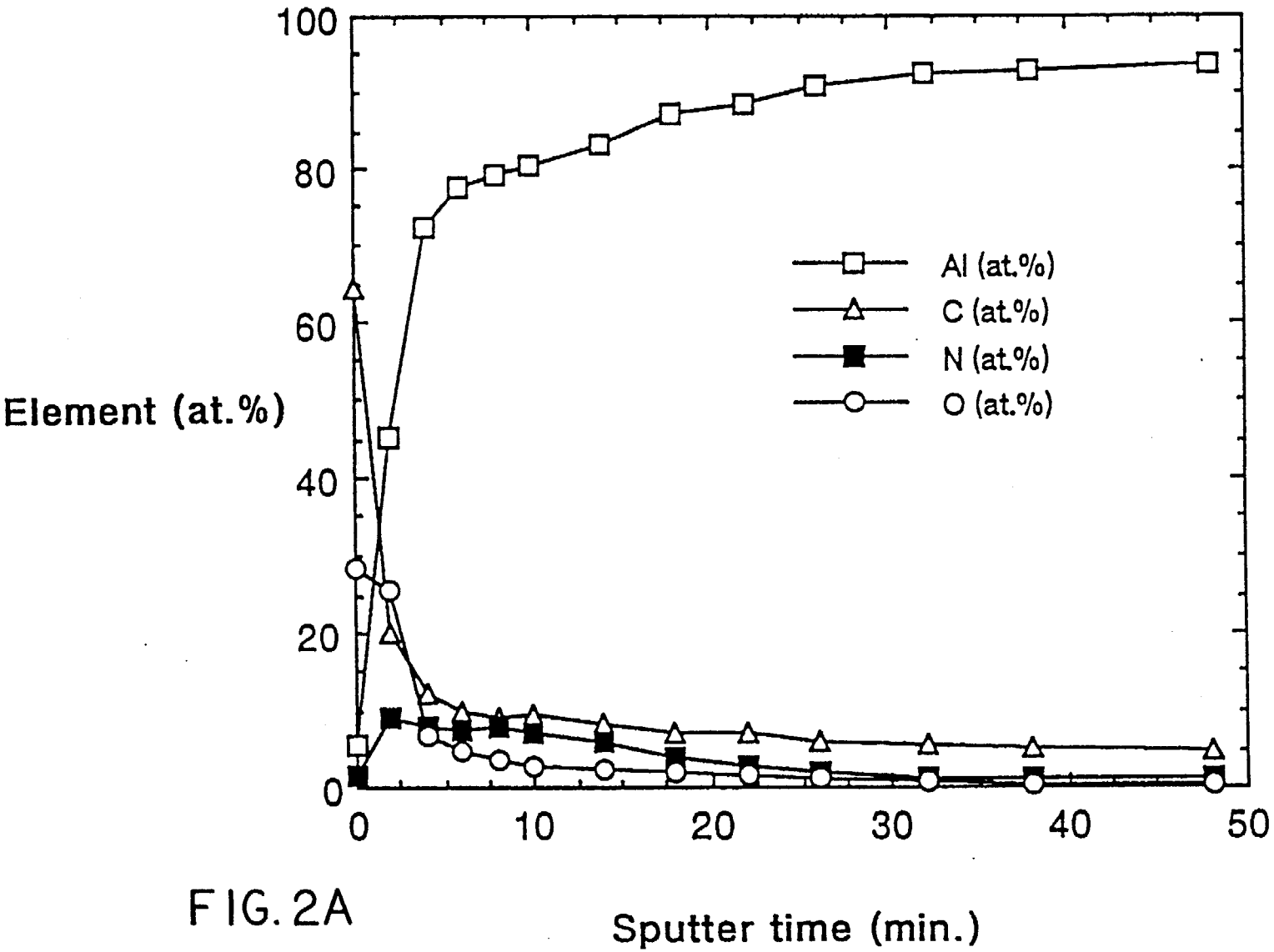
FIGS. 2A and 2B are graphs depicting Auger electron spectroscopy data for atomized aluminum powder particles made in accordance with one embodiment of the invention and showing an unexpected supersaturation of the aluminum powder particle matrix with nitrogen to a depth of at least 1000 Angstroms.
Figure 2B:
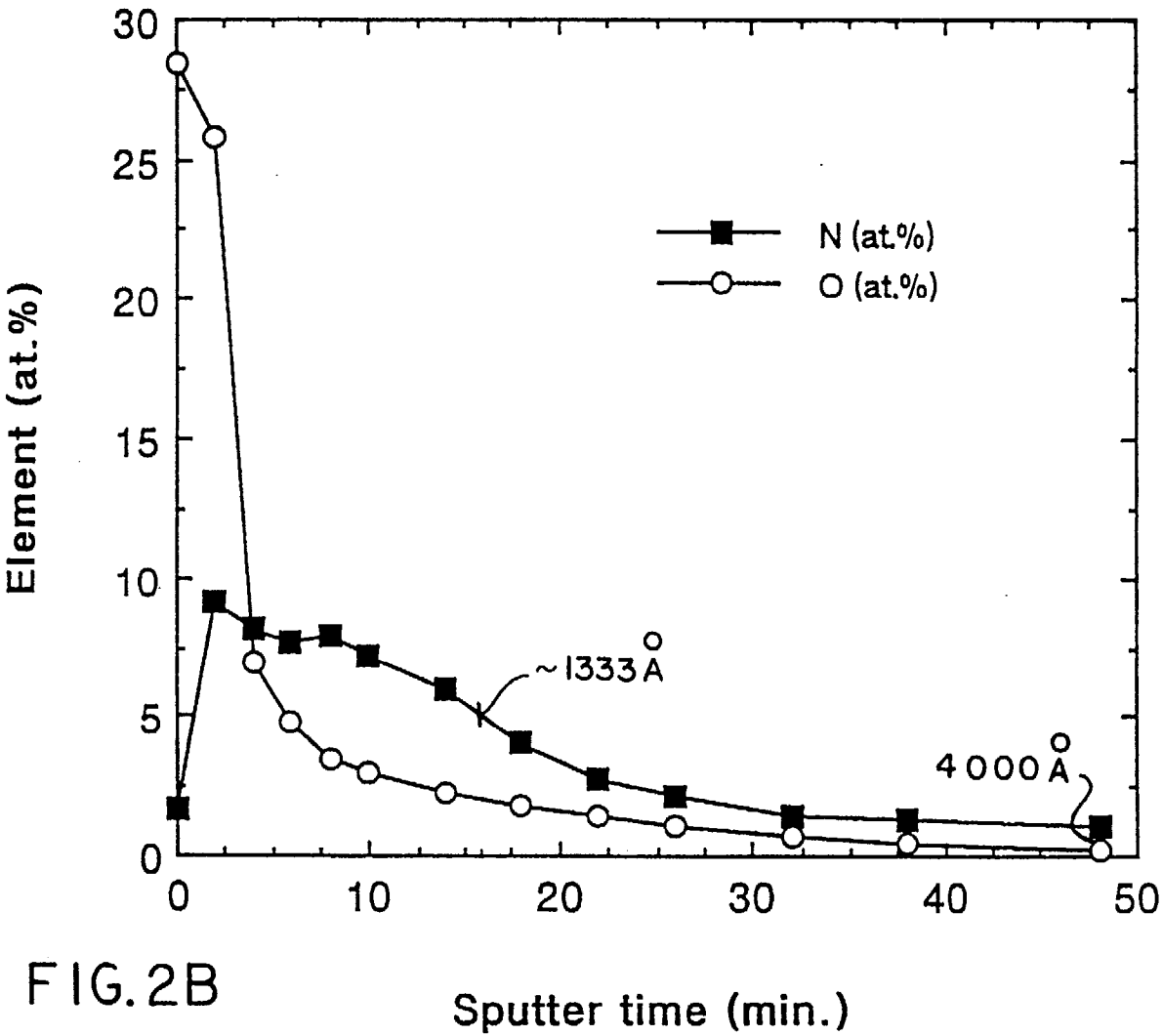

The atomization parameters (e.g. gas stoichiometry, melt superheat, atomization gas pressure, chemistry of gas species) can be adjusted to achieve the aforementioned surprisingly high supersaturation of nitrogen throughout the particle cross-section, rather than in a surface region. For example, at a given level of reaction kinetics, an enhanced atomization energy level can produce smaller atomized droplets which, on average, would experience penetration of the dissolved atomic specie throughout the entire particle diameter, as the supersaturated surface region or zone approaches overlap at the droplet center. Atomization parameter(s) can be adjusted to this end. Supersaturation of nitrogen can be achieved across the substantially whole particle rather than a surface region as is evident from the data set forth in FIG. 2.

Example 1 sets forth conditions of melt temperature and ratio of carrier gas/second (nitrogen) gas effective to achieve a surprisingly high superequilibrium concentration of dissolved nitrogen throughout the diameter of fine, spherical aluminum powder particles. Five (5) atomic % dissolved nitrogen is present to a depth of 1300 Angstroms from the surface of the particles (size of 25 microns). This compares to an equilibrium concentration of 0.1 atomic % nitrogen in face centered cubic aluminum at 1400° C. and $1\times10^{-11}$ atomic % nitrogen in face centered cubic aluminum at 660° C. A nitrogen concentration of 1.0 atomic % (forming a level concentration plateau) is present after 48 minutes of sputtering (FIGS. 2A, 2B), indicating a nitrogen supersaturation extending to a depth of 4000 Angstroms below the particle surface.

The powder particles having the superequilibrium concentration of the atomic specie of the second gas dissolved in solid solution therein can then be heated to a temperature sufficient to react the dissolved atomic specie with the metallic matrix material of the powder particles to form dispersoids in-situ therein. The temperature and time at temperature required to effect in-situ dispersoid formation will depend on the particular composition of the matrix metal or alloy involved and the particular dissolved dispersoid-forming specie and concentration thereof dissolved in the particle matrix. Suitable temperature and time at temperature parameters can be readily determined on an empirical basis.

For example, with respect to the aforementioned aluminum powder particles described here above having 5 atomic % nitrogen dissolved in the surface region of the particles, a temperature of 575° C. and time at temperature of 240 minutes were effective to react the dissolved nitrogen and the aluminum matrix to form fine aluminum nitride refractory dispersoids (refractory compounds) distributed uniformly throughout the whole cross-section (diameter) of the particles, FIG. 3. The aluminum nitride dispersoids have been observed to coarsen to only approximately 1.5 micron diameter maximum after heating at 575° C. for 4 hours.

The heat treated particles can then be formed into an article of manufacture using conventional powder metallurgy techniques wherein the particles typically are cold or hot compacted in a mold or container to a desired shape and then metallurgically bonded together by heat and pressure using known sintering or hot isostatic pressing techniques.

Alternately, the as-atomized powder particles having the superequilibrium concentration of the dispersoid-forming specie can be formed directly into an article of manufacture using the aforementioned conventional powder metallurgy techniques. The temperature employed in the compaction operation and/or the sintering or hot isostatic pressing operation would be employed to effect reaction of the dissolved specie with the powder particle matrix metal or alloy to form dispersoids in-situ throughout the article.

Regardless of the processing sequence employed, the powder metallurgy article produced will be strengthened by the presence of the uniform distribution of fine dispersoids in the microstructure thereof. With respect to an article having aluminum nitride dispersoids distributed in an aluminum or aluminum alloy matrix, the dispersoids should be thermally stable at elevated temperatures far in excess of conventional precipitation hardened aluminum alloys such as the 2000, 5000, and 7000 series alloys. However, the invention is not limited to aluminum and aluminum alloy matrices and can be practiced with respect to other metals and alloys including, but not limited to, Cu, Fe, Ti, Ni, Zr, Co and Ag.

The following Example is offered to further illustrate, but not limit, the embodiments of the invention described hereabove.

EXAMPLE 1

The melting furnace was charged with a pure aluminum charge (oxygen content of 35 ppm by weight) weighing 250 grams. The charge was melted in the induction melting furnace in a high purity, coarse grain alumina crucible (Alundum-An 229A obtained from Norton Refractories). A pour tube and stopper rod both made of high purity boron nitride (Type A boron nitride from Carborundum Corp.) were used. The charge was melted in the induction melting furnace after the melting chamber and the drop tube were evacuated to $3.4\times10^{-5}$ atmosphere and then pressurized with argon to 1.1 atmosphere. The melt was heated to a temperature of 1405° C. (providing 745 degrees C superheat above the aluminum melting point). After a hold period of 2 minutes to stabilize the metal temperature, the melt was fed via the pour tube to the atomizing nozzle by gravity flow upon raising of the boron nitride stopper rod. The atomizing nozzle was of the type described in U.S. Pat. No. 5,125,574, the teachings of which are incorporated herein by reference with respect to the nozzle construction.

The atomizing gas comprised a mixture of argon and nitrogen in a ratio of 90:10 (i.e. 90 volume % Ar and 10 volume % nitrogen). The argon gas and nitrogen gas mixture was supplied at 750 psig (measured at the respective gas supply regulator) to the atomizing nozzle. Ultra high purity (99.995%) argon and nitrogen gas were supplied to the atomizing nozzle as a factory-made mixture. The flow rate of the atomizing gas mixture to the atomizing nozzle was about 150 scfm (standard cubic feet per minute).

Spherical aluminum powder particles were produced in a size range of 1 to 150 microns. Auger electron spectroscopy (AES) at room temperature was used to gather chemical composition data on the powder particles. The AES analysis (see FIGS. 2A, 2B) of representative powder particles indicated a dissolved atomic nitrogen concentration of at least approximately 5 atomic % to a depth of approximately 1300 Angstroms in the atomized powder particles (diameter of 25 microns). Below that depth, to at least 4000 Angstroms below the particle surface, the nitrogen concentration was about 1 atomic %. These values of dissolved solid solution nitrogen are far in excess of those expected by the equilibrium phase diagram for nitrogen solubility in aluminum. For example, at 660 and 1400 degrees C, the equilibrium concentration of nitrogen in aluminum is indicated by the phase diagram to be $1\times10^{-11}$ atomic % and 0.1 atomic %, respectively.

Moreover, the microstructure of the atomized aluminum powder particles was determined to be a cellular/-dendritic structure by scanning electron micrograph examination. This as-atomized microstructure was unexpected in pure aluminum powder particles because the normal lack of impurities eliminates the rejection of a second phase to cell or dendrite boundaries, resulting in huge pure metal dendrites. In powder particles of these sizes, multiple dendrite arms or cells would not be observed.

Figure 3A:
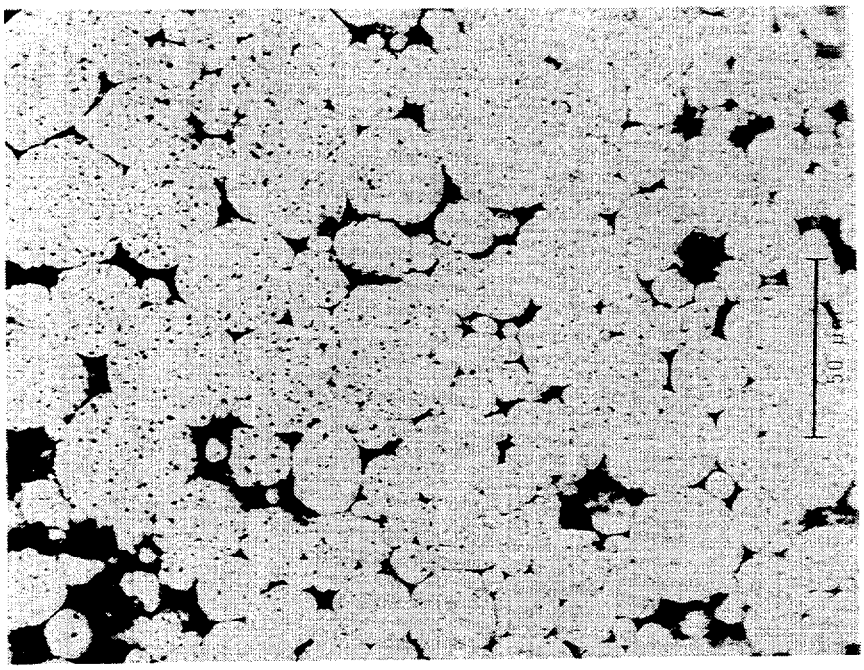
FIGS. 3A and 3B are scanning electron micrographs of an atomized powder particle heat treated at 575° C. for 240 minutes to form a fine, uniform dispersion of aluminum nitride dispersoids throughout the aluminum powder particle matrix.
Figure 3B:
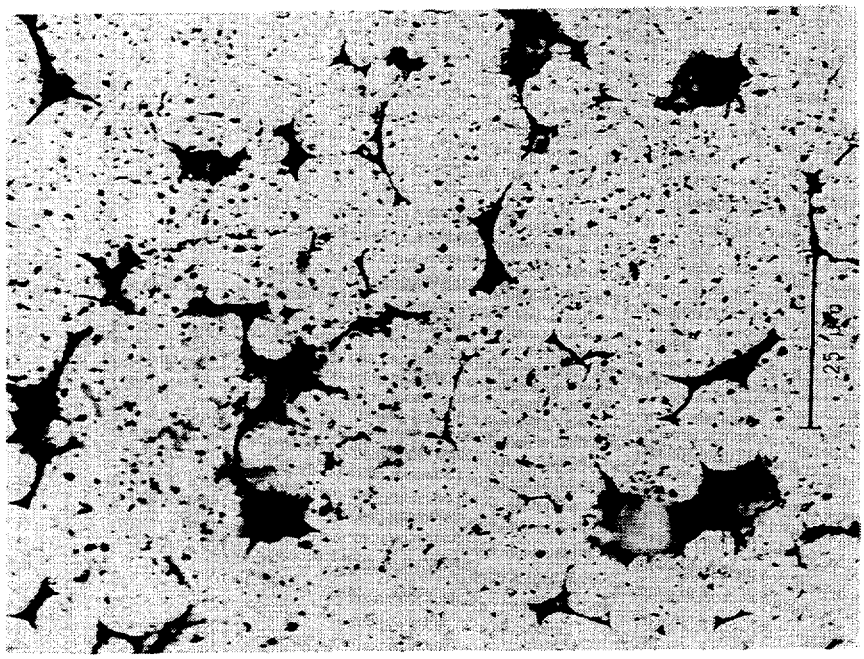

The atomized aluminum powder particles were heat treated and partially consolidated in a hot isostatic press (pressure 45 ksi) at 575° C. for 240 minutes and metallographically examined. FIGS. 3A and 3B are scanning electron micrographs representative of a heat treated particle compact apparently showing a fine, uniform dispersion of aluminum nitride refractory particles (dispersoids) throughout the aluminum matrix. The dispersoid size (diameter) was about 1.5 to 0.1 microns in diameter. The very fine size and uniform dispersion of the aluminum nitride dispersoids should provide a large amount of strengthening as a particle hardening phase. As mentioned hereabove, the aluminum nitride refractory dispersoids should be stable at elevated temperatures at least as high as 575° C. far in excess of conventional 2000, 5000, and 7000 series precipitation hardened alloys which coarsen severely at 300° C.

The atomized powder particles supersaturated with nitrogen can be formed directly (i.e. without heat treatment) into an article of manufacture by the conventional powder metallurgy processes mentioned hereabove wherein the processing conditions will effect formation of the aluminum nitride dispersoids in-situ in the powder particle matrix and thus strengthen the article. Alternately, the powder particles can be heat treated prior to powder metallurgy processing into an article of manufacture.

The invention has been described hereabove with respect to forming powder particles supersaturated with a dissolved, reactive specie in the atomization spray zone ZZ. Thereafter, the powder particles are heated in a subsequent operation to react the dissolved specie with the particle matrix material to form a dispersion of refractory compounds (e.g. aluminum nitrides) in-situ throughout the particle matrix.

The invention also involves in another embodiment controlling the atomizing conditions to effect reaction of the melt and the atomizing gas to form refractory or intermetallic compounds in the atomized powder particles during atomization. That is, in this method embodiment, a refractory or intermetallic compound having a first metallic component and a second non-metallic or metallic component is formed in the atomization spray (zone ZZ) by chemical reaction between the melt and a reactive material of the atomizing gas during atomization of the melt.

In particular, this method embodiment involves forming a superheated melt comprising the first metallic component of the compound under an inert gas atmosphere in the melting furnace 18 and atomizing the melt using an atomizing gas comprising a reactive material whose reactivity with the melt is selected to provide the second non-metallic or metallic component of the compound. The chemical reaction between the melt and the reactive material in the atomization spray zone ZZ is thermodynamically driven by the heat of the reaction and the superheat of the melt, not by an outside heat source such as in calcining. The atomized particles rapidly solidify to produce atomized powder particles comprising the refractory or intermetallic compound therein.

The atomizing gas supplied to the nozzle 22 can be comprised solely of a reactive gas in this embodiment. Alternately, the atomizing gas can comprise a mixture of a carrier gas and a reactive material such as a reactive gas or liquid. In either case, the reactive material is chemically reactive with the superheated melt in the atomization spray zone ZZ to form the refractory or intermetallic compound in the atomized powder particles.

The reactive gas is supplied from a conventional source, such as a high pressure gas cylinder or bottle 42 as illustrated in FIG. 1. If a carrier gas and reactive gas are used as the atomizing gas, they are supplied either from a pre-mixed high pressure gas mixture cylinder or from high pressure cylinders 40, 44 and mixed in the conduit 25 communicated to the atomizing nozzle 22 in FIG. 1. The carrier gas typically would comprise an inert gas, such as preferably ultra high purity argon, although the invention is not limited to use of inert gas as the carrier gas.

If an atomizing gas and a liquid reactive material are used, they are mixed by interaction in a carburetor-like chamber 45 located at the junction of supply conduits 40*a*, 44*a* in FIG. 1.

The reactive gas or material is selected to provide the non-metallic or metallic component of the refractory or intermetallic compound, respectively, to be formed in the atomization spray zone ZZ. For example, the reactive gas or material can comprise ultra high purity nitrogen to form atomized powder particles comprising a nitride compound; e.g. aluminum nitride. The reactive gas or material can comprise ultra high purity borane to form atomized powder particles comprising a boride compound; e.g. aluminum boride. The reactive gas or material can also comprise an ultra high purity organo-metallic liquid to form an intermetallic compound; e.g. titanium aluminide, nickel aluminide, iron silicide, iron germanide, etc. The organo-metallic liquid can comprise a carbonyl, aryl, alkene, or allyl of the appropriate metal. These liquids thermally decompose in zone ZZ.

As mentioned, a reactive gas can be used solely as the atomizing gas without the need for a carrier gas as described, for example, in Example 2. Alternately, a carrier gas/reactive gas mixture can be used as the atomizing gas. In this situation, the reactive gas would comprise a majority (vol. %) of the mixture while the carrier gas comprises a minority (vol. %) in this embodiment of the invention in order to effect the necessary reaction of the melt and gas in the atomization spray zone ZZ to form the desired refractory or intermetallic compounds in the atomized powder particles.

The melt superheat temperature and the reactivity of the reactive material are selected to effect the desired melt/reactive gas reaction in the atomization spray to form the refractory or intermetallic compound in-situ in the atomized melt droplets. Once the melt/reactive gas reaction occurs in the atomization spray, the cooling rate of the atomized melt droplets is sufficiently rapid to form fine powder particles comprising the refractory or intermetallic compound therein. The powder particles are then collected in the collection chamber 14 for subsequent processing by powder consolidation techniques.

The melt superheat temperature and reactive gas composition required to effect the synthesis of the refractory or intermetallic compound in the atomization spray zone ZZ will depend on the particular compounds to be formed. Suitable melt temperature and reactive gas compositions can be readily determined by reference to tables of standard free energies of formation of the compounds and/or on an empirical basis depending the refractory or intermetallic compound desired.

The following Example is offered to further illustrate, but not limit, the embodiment of the invention described hereabove.

EXAMPLE 2

The melting furnace was charged with chill cast pieces of $Nd_2Fe_{14}B$ from Research Chemicals Corp., FeB pieces from Shieldalloy Corp., and pieces of Nd-16 weight % Fe from thermite reduction. The pieces were charged in appropriate amounts to provide a melt composition comprising $Nd_2Fe_{14}B_{1.5}$. The total charge weight was 1000 grams. The charge was melted in the induction melting furnace in a high purity, coarse grain alumina crucible. A pour tube and stopper rod both made of boron nitride were used. The charge was melted after the melting chamber and the drop tube were evacuated to $30\times10^{-3}$ torr and then pressurized (backfilled) with ultra high purity argon to 1.1 atmospheres. The melt was heated to a temperature of 1600° C. (providing 350 degrees C of superheat above the alloy liquids). After a hold period of 2 minutes to stabilize the temperature, the melt was fed to the atomizing nozzle by gravity flow upon raising of the boron nitride stopper rod. The atomizing nozzle was of the type described in U.S. Pat. No. 5,125,574, the teachings of which are incorporated herein by reference with respect to the nozzle construction.

The atomizing gas comprised solely ultra high purity nitrogen at 1700 psig (measured at the gas supply regulator). The flow rate of the nitrogen gas to the atomizing nozzle was about 300 scfm.

Figure 5:
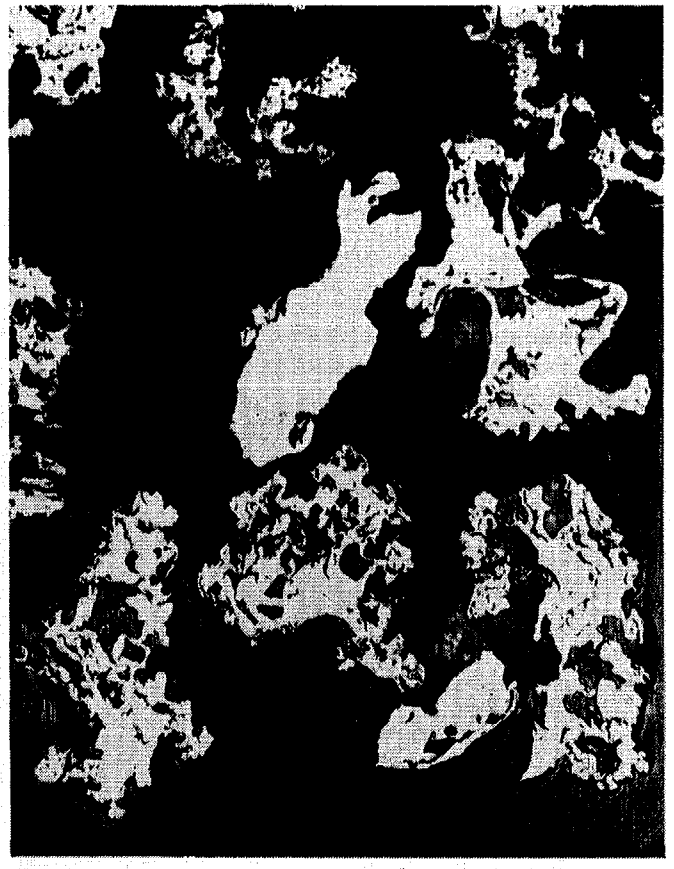
FIGS. 4 and 5 are photomicrographs of atomized powder particles comprising Nd nitride refractory compound in an iron matrix.
Figure 4:
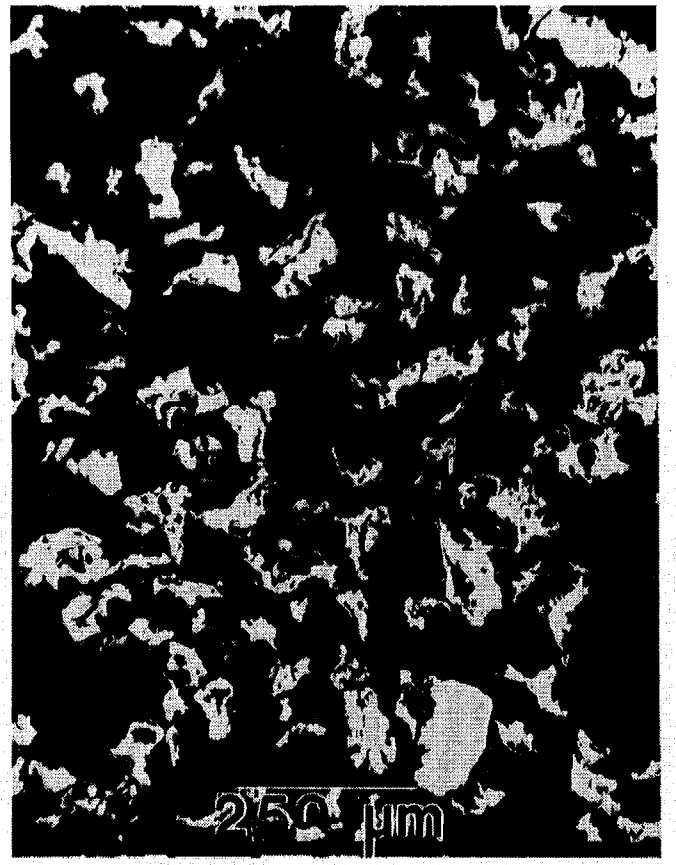
Figure 7:
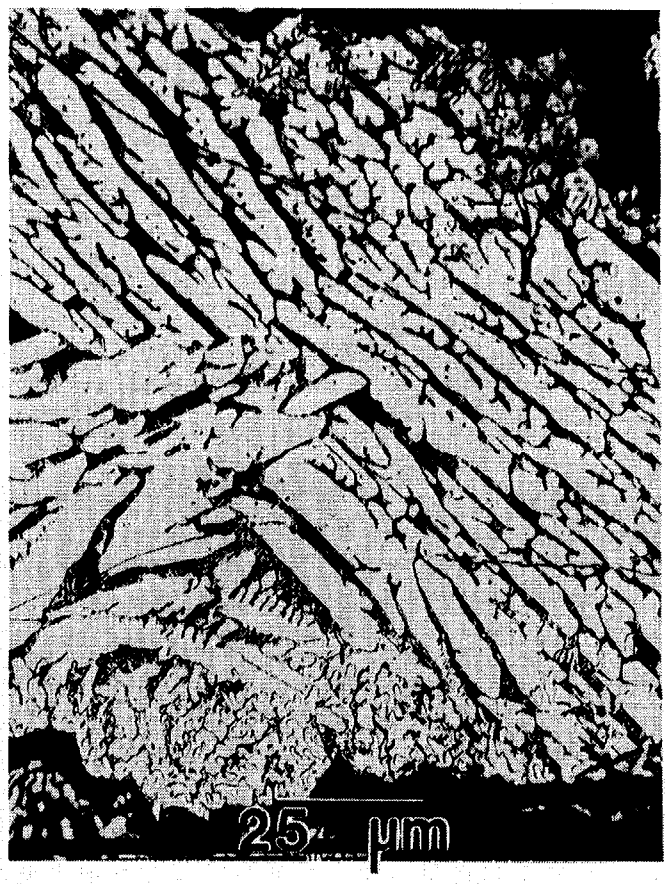
FIGS. 6 and 7 are photomicrographs of atomized powder particles comprising Nd nitride refractory compound in an iron matrix, cross-sectioned and etched to reveal the microstructure.
Figure 6:
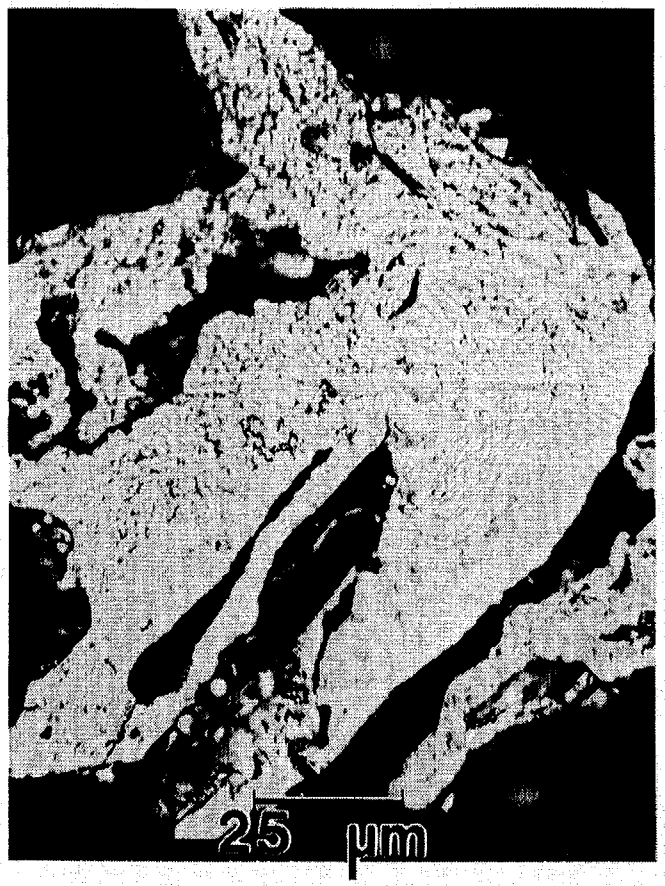

Irregular shaped (raisin-shaped) powder particles were produced in a size range of about 1 to 300 microns with 50% of the particles greater than about 180 microns in diameter. FIG. 4 is a photomicrograph of the atomized powder particles mechanically screened to a particle size range from 63 microns to less than 74 microns. FIG. 5 is a similar photomicrograph of the atomized powder particles mechanically screened to a particle size range from 200 to 300 microns. FIGS. 6 and 7 are photomicrographs of representative powder particles from the respective size ranges of FIGS. 4 and 5 metallographically mounted, polished and etched (Nital etchant) to reveal the particle microstructure. The microstructural analysis revealed iron dendrites with a Nd-rich interdendritic phase present.

X-ray diffraction of the atomized particles revealed that the dominant phase was iron (bcc) with a second phase of neodymium nitride being present. Only a trace of $Nd_2Fe_{14}B$ was present. Based on wet chemical analysis, vacuum fusion analysis, and micro-kjeldahl analysis, it appeared that at least 95% of the original Nd in the melt was converted to the refractory nitride compound in the atomization spray zone.

This embodiment of the invention is not limited to the Nd-Fe-B alloys described hereabove. For example, other metals and alloys including, but not limited to, Fe, Ni, Co, Cu, Ag might be atomized using an atomizing gas comprising a reactive material under conditions to produce fine powder particles with a refractory or intermetallic compound formed in-situ therein in the atomization spray zone ZZ of the atomization apparatus.

The combination of melt atomization with synthesis of the refractory or intermetallic compound in the atomization spray zone avoids the difficulties heretofore encountered in conventional solidification processing of refractory or intermetallic compounds resulting from their high melting points and extreme chemical reactivity.

While the invention has been described in terms of specific embodiments thereof, it is not intended to be limited thereto but rather only to the extent set forth hereafter in the following claims.

The embodiments of the invention in which an exclusive property or privilege is claimed are defined as follows:

1. A method of making particles, comprising:

forming a melt comprising a metal or alloy under an inert gas atmosphere, atomizing said melt with an atomizing gas mixture comprising a carrier gas and a second gas or a liquid so as to form atomized particles, the temperature of said melt and the ratio of said carrier gas to said second gas or liquid being selected to provide a superequilibrium concentration of an atomic specie of said second gas or liquid in solid solution in said atomized particles to a depth below the surface of said atomized particles, and solidifying the atomized particles to retain the superequilibrium concentration of said atomic specie therein.

2. The method of claim 1 wherein the atomizing gas mixture comprises an inert gas and a reactive, dispersoid-forming gas that will react when dissolved in solid solution in the metal or alloy to form dispersoids therein.

3. A method of making aluminum particles, comprising:

forming a melt comprising aluminum under an inert gas atmosphere, atomizing said melt with an atomizing gas mixture comprising an inert gas and nitrogen so as to produce atomized particles, the temperature of said melt and the ratio of said inert gas to nitrogen gas being effective to provide a superequilibrium concentration of atomic nitrogen in solid solution to a depth below the surface of said particulates and solidifying the atomized particles to retain the superequilibrium concentration of nitrogen therein.

4. A method of dispersion strengthening a metallic material, comprising:

forming a melt comprising a metal or alloy under an inert gas atmosphere, atomizing said melt with an atomizing gas mixture to produce atomized particulates, said atomizing gas mixture comprising a carrier gas and a reactive gas that is reactive when dissolved in solid solution in said metallic material to form dispersoids therein, the temperature of said melt and the ratio of said carrier gas to said reactive gas being selected to provide a superequilibrium concentration of an atomic specie of said reactive gas in solid solution in said atomized particles to a depth below surface of said atomized particles upon solidification thereof, solidifying the atomized particles to retain the superequilibrium concentration of the atomic specie therein, and heating the atomized particles to a temperature to react said atomic specie of said reactive gas in solid solution with the solidified metal or alloy particles to form dispersoids therein.

5. The method of claim 4 wherein the atomizing gas comprises an inert gas and said reactive gas.

6. A method of making dispersion strengthened aluminum particles, comprising:

forming a melt comprising aluminum under an inert gas atmosphere, atomizing said melt with an atomizing gas mixture comprising an inert gas and nitrogen so as to produce atomized particles, the temperature of said melt and the ratio of said inert gas to nitrogen gas being effective to provide a superequilibrium concentration of atomic nitrogen in solid solution in said atomized particles to a depth below the surface of said atomized particles upon solidification, solidifying the atomized particles to retain the superequilibrium concentration of nitrogen therein, and heating the atomized particles to a temperature to react said atomic nitrogen in solid solution with said aluminum to form dispersoids therein.

7. A method of making a dispersion strengthened article, comprising:

forming a melt comprising a metal or alloy under an inert gas atmosphere, atomizing said melt with an atomizing gas mixture to produce atomized particles, said atomizing gas comprising a carrier gas and a reactive gas that is reactive when dissolved in solid solution in said metallic material to form dispersoids therein, the temperature of said melt and the ratio of said carrier gas to said reactive gas being selected to provide a superequilibrium concentration of an atomic specie of said reactive gas in solid solution in said atomized particles to a depth below a surface of said atomized particles upon solidification, solidifying the atomized particles to retain the superequilibrium concentration of the atomic specie therein, forming an article from said atomized particles, and heating the solidified particles during or after formation of said article to a temperature to react said specie with said metallic material to form dispersoids therein.

8. A method of making a dispersion strengthened aluminum article, comprising:

forming a melt comprising aluminum under an inert gas atmosphere, atomizing said melt with an atomizing gas mixture comprising a carrier gas and nitrogen so as to produce atomized particles, the temperature of said melt and the ratio of said carrier gas to said nitrogen gas being selected to provide a superequilibrium concentration of atomic nitrogen in solid solution in said atomized particles to a depth below the surface of said atomized particles upon solidification, solidifying the atomized particles to retain the superequilibrium concentration of nitrogen therein, forming an article from said atomized particles, and heating the solidified particles during or after formation of said article to a temperature to react said atomic nitrogen with said aluminum to form aluminum nitride dispersoids in said aluminum.

9. A method of making particles comprising a refractory or intermetallic compound having a first metallic component and a second non-metallic or metallic component, comprising:

forming a melt comprising said first metallic component of said compound under an inert gas atmosphere, atomizing said melt with an atomizing gas comprising a reactive material that is reactive with said melt to provide said second non-metallic or metallic component of said compound, the temperature of said melt and amount of said reactive material being selected to effect reaction of said melt and said reactive material in an atomization spray so as to form said compound in atomized particles produced by atomization of said melt to a depth below the surface of said atomized particles, and solidifying the atomized particles to provide particles comprising said compound therein.

10. The method of claim 9 wherein the reactive material comprises a reactive gas.

11. The method of claim 9 wherein the reactive gas is used solely as the atomizing gas.

12. The method of claim 9 wherein reactive gas comprises nitrogen gas to form a nitride compound in said atomization spray.

13. The method of claim 9 wherein the reactive gas comprises substantially borane to form a boride compound in said atomization spray.

14. The method of claim 9 wherein the reactive material comprises a metallo-organic gas or liquid to form an intermetallic compound in said atomization spray.

15. The method of claim 9 wherein the melt is superheated to supplement the heat of reaction to drive the reaction in said atomization spray.

16. A method of making particles comprising a refractory or intermetallic compound having a first metallic component and a second non-metallic or metallic component, comprising:

forming a superheated melt comprising said metallic component of said compound under an inert gas atmosphere, atomizing said melt with an atomizing gas that is reactive with said melt to provide said non-metallic or metallic component of said compound, the temperature of said melt and amount of said reactive atomizing gas being selected to effect reaction of said melt and said reactive material in an atomization spray so as to form said compound throughout atomized particles produced by atomization of said melt, and solidifying the atomized particles to provide particles comprising said compound therein.

17. The method of claim 16 wherein the atomizing gas comprises nitrogen gas to form a nitride compound in said atomization spray.

18. The method of claim 16 wherein the atomizing gas comprises borane to form a boride compound in said atomization spray.

* * * * *